US008242475B1

(12) United States Patent
Cheng

(10) Patent No.: US 8,242,475 B1
(45) Date of Patent: Aug. 14, 2012

(54) UV LIQUID GEL SOLIDIFYING DEVICE FOR NAIL ART

(75) Inventor: Kuo-Chang Cheng, New Taipei (TW)

(73) Assignee: Cosmex Co., Ltd., Taipei (TW)

( * ) Notice: Subject to any disclaimer, the term of this patent is extended or adjusted under 35 U.S.C. 154(b) by 0 days.

(21) Appl. No.: 13/211,284

(22) Filed: Aug. 16, 2011

(51) Int. Cl.
*A61N 5/06* (2006.01)
*G02B 5/26* (2006.01)
*B05B 5/025* (2006.01)

(52) U.S. Cl. ..... 250/504 R; 250/504 H; 250/461.1; 118/620; 252/588; 34/275

(58) Field of Classification Search ..... 250/504 R, 250/504 H, 365, 372, 393, 522.1, 526, 461.1; 252/588, 589; 34/275; 118/620, 642, 643, 118/506
See application file for complete search history.

(56) References Cited

U.S. PATENT DOCUMENTS 6,783,705 B1 * 8/2004 Leveille ..... 252/588
2011/0252661 A1 * 10/2011 Li et al. ..... 34/275
2011/0277338 A1 * 11/2011 Li et al. ..... 34/275
2012/0060757 A1 * 3/2012 Li et al. ..... 118/620

* cited by examiner

*Primary Examiner* — Bernard E Souw
(74) *Attorney, Agent, or Firm* — Lin & Associates IP, Inc.

(57) ABSTRACT

A UV liquid gel solidifying device includes a support member, a UV LED module, a top cover, and a base. The UV LED module is installed on the support member and emits light into a first chamber of the support member. The support member is disposed on the base, and the base has a third chamber defined there beneath. The top cover is assembled on the support member and has a slide cover slideably mounted thereto. When the slide cover moves toward a first direction, the first open end and the second open end are opened so that the user's fingernails can be put in the first chamber for treatment. When the slide cover is released to revert back to close the first open end and the second open end, the user's eyes can avoid from being directly exposed to the UV light. When the toenails are to be treated, the base can be conveniently disassembled from the support member, and the toenails to be treated are inserted into the first chamber for treatment.

9 Claims, 6 Drawing Sheets

UV LIQUID GEL SOLIDIFYING DEVICE FOR NAIL ART

BACKGROUND OF THE INVENTION

1. Field of the Invention

The present invention generally relates to an ultraviolet (UV) solidifying device, and in particular to a UV solidifying device using a UV Light Emitting Diode (UV LED) light source to solidify the UV liquid gel coated on the nails of the users' fingers and toes.

2. The Prior Arts

In nail art, the use of UV light to treat the UV liquid gel coated on the nails of toes and fingers is a known method. An existed UV solidifying device for nail art is configured to have an inverse U-shaped case and the fingers are put in the notches of the case for treatment by the UV light. The solidifying device can also be rotated 180 degrees and held by hand to allow the UV light to light the toenails. The defect of the conventional UV solidifying devices is that while the toenails are treated by the UV light, the hands have to keep a fixed pose and the body also has to keep a fixed pose to let the toes be at a desired position. After a period of time, the hands and the body will feel pain and fatigue. Besides, there is no shade to cover the UV light source, so that the user's eyes are directly exposed to and injured by the UV light. Another commonly used solidifying device for nail art includes a case and a UV light source received therein. The case has an opening at one end thereof, so that the user's fingers can be inserted therein for treatment by the UV light. Since the UV light source is enclosed in the case, the user's eyes are not directly exposed to the UV light. However, while in use, the case has to be moved to an edge of a table for allowing the fingers to insert into the case and rest on the table, and the other fingers not to be treated are located under the table. If the case is put at a center of the table, it is difficult to treat one single finger.

The conventional UV solidifying devices may harm the user's eyes, have to be put in the edge of the table while in use, and can not conveniently treat the fingernails and the toenails. Therefore, it is desired to provide a UV liquid gel solidifying device that improves the shortcomings of the conventional UV solidifying devices.

SUMMARY OF THE INVENTION

A primary objective of the present invention is to provide a UV liquid gel solidifying device which is able to conveniently solidify the UV liquid gel coated on the fingernails and the toenails.

Another objective of the present invention is to provide a UV liquid gel solidifying device which can be put at any position of a table while in use.

Yet another objective of the present invention is to provide a UV liquid gel solidifying device which can protect the users' eyes from being directly exposed to the UV light.

Still another objective of the present invention is to provide a UV liquid gel solidifying device which can be easily assembled and disassembled.

In order to achieve the above-mentioned objectives, a UV liquid gel solidifying device for nail art according to the present invention comprises a support member, at least one UV LED module, a top cover, and a base.

The support member has multiple walls arranged to have an included angle between adjacent two walls and define a first chamber with a first open end. The walls are a light reflective wall.

The at least one UV LED module is installed to one of the walls and has a UV LED light source facing toward the first chamber. The walls can reflect and guide light emitted from the UV LED light source.

The controller is disposed to another wall, and the controller is electrically connected to the at least one UV LED module.

The top cover is detachably mounted to a top of the support member and has a second chamber defined there beneath for receiving the support member and a second open end parallel to the first open end. The top cover has a slide cover slideably mounted thereto. When the slide cover moves toward a first direction, the first open end and the second open end are opened, so that the user's fingernails can be put in the first chamber for treatment. When the slide cover moves backward, the first open end and the second open end are closed so that the user's eyes avoid from being directly exposed to the UV light while in use.

The base is detachably connected to an underside of the support member and has a third chamber defined there beneath and a third open end located at the same side as the first open end. The third chamber is isolated from the UV LED light source. The fingers to be treated by the UV LED light can insert into the first chamber and put on a top surface of the base, and the remaining fingers not to be treated can insert into the third chamber. When the base is disassembled from the support member, the toenails coated with the UV liquid gel can be inserted and treated in the first chamber.

As described above, when the UV liquid gel solidifying device is assembled with the base, it is suitable for treating the fingernails. The fingernails to be treated can insert in the first chamber and put on the top surface of the base, and the remaining fingers not to be treated can insert into the third chamber. The UV liquid gel solidifying device can be put at any position of a table while in use. It is not needed to put it at the edge of the table. When the toenails are to be treated, the base is disassembled from the support member, and then the support member and the top cover are disposed over the toenails. Therefore, the UV liquid gel solidifying device can treat both of the fingernails and the toenails.

In operation, the slide cover is pushed upward to open the first open end and the second open end for insertion of the fingers. The slide cover is then released to revert back to its original position to close the first and second open ends, so that the user's eyes are not exposed to the UV light while in use.

The top cover, the support member, and the base are detachably assembled together by bolts or magnets, so as to be easily assembled and disassembled.

Compared with the conventional solidifying devices, the UV liquid gel solidifying device of the present invention has the advantages of wider application range, more safety, and more convenient use.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
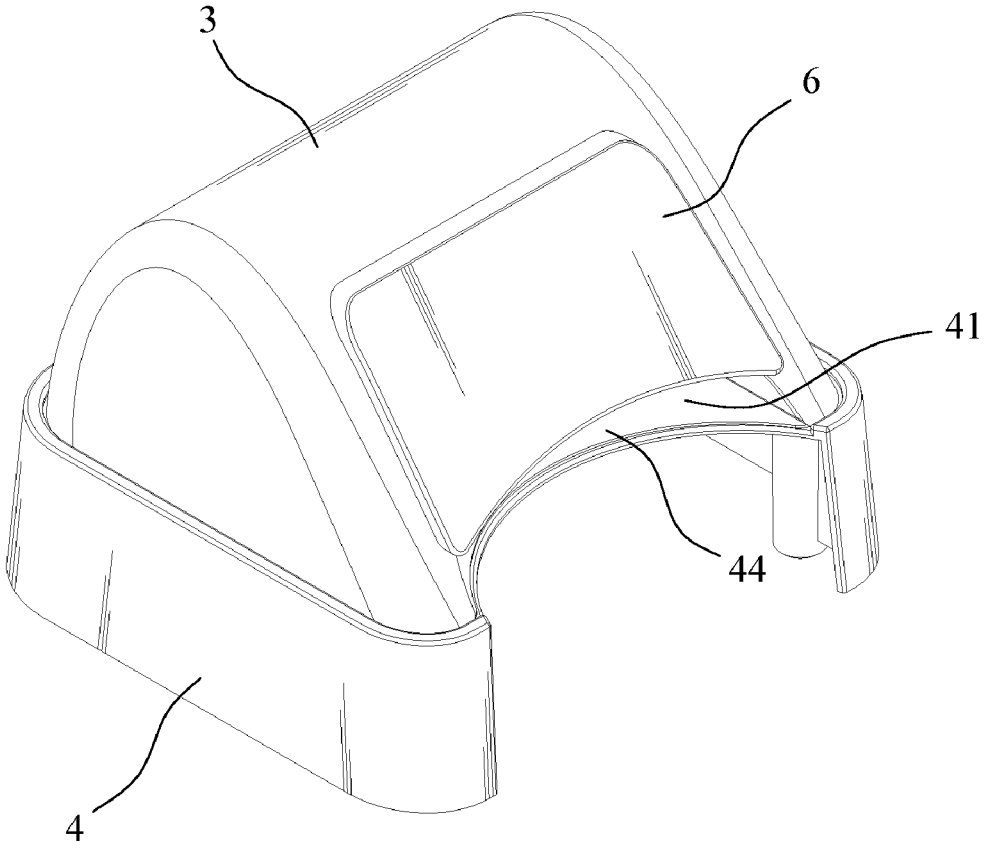
FIG. 1 is a perspective view showing an ultraviolet (UV) liquid gel solidifying device in accordance with the present invention.
Figure 2:
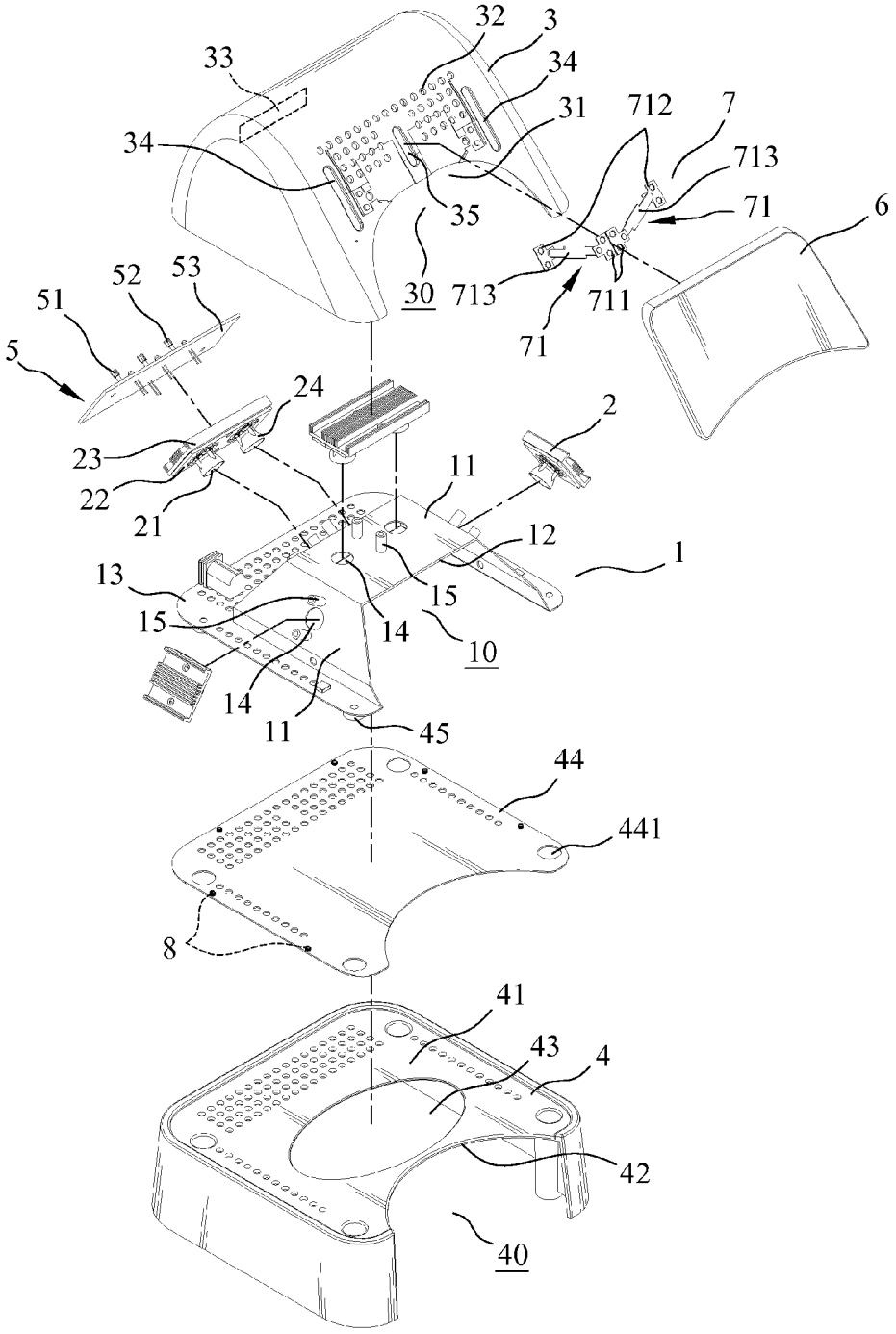
FIG. 2 is an exploded perspective view of the UV liquid gel solidifying device of the present invention.
Figure 3:
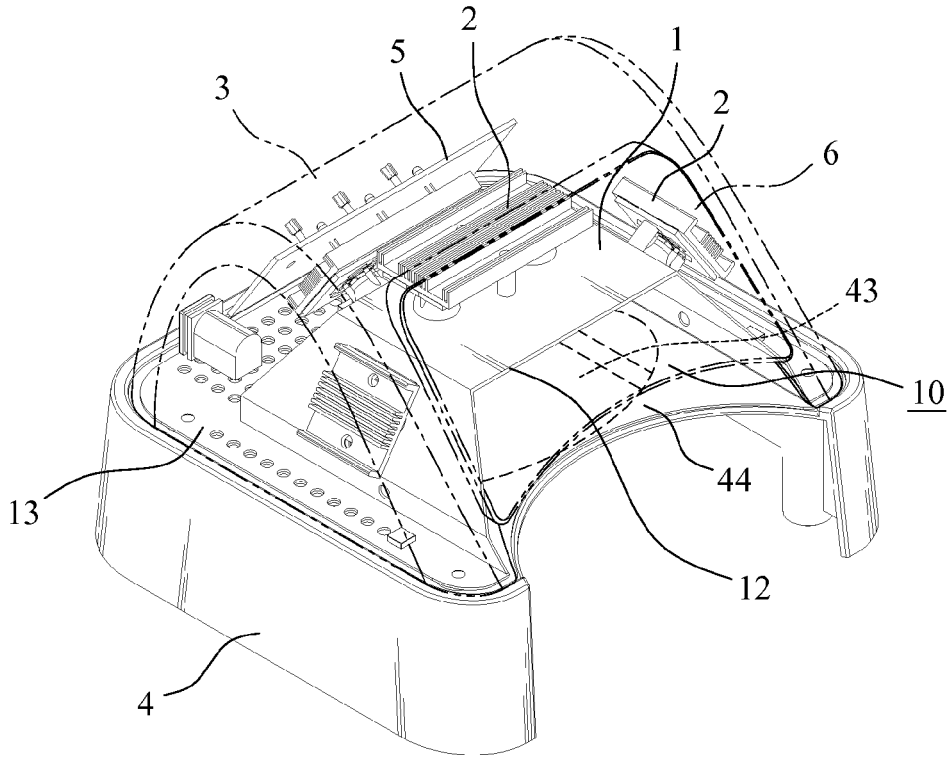
FIG. 3 is another perspective view showing the UV liquid gel solidifying device in accordance with the present invention, wherein the top cover is shown by dotted lines.

With reference to the drawings and in particular to FIGS. 1 to 3, an ultraviolet (UV) liquid gel solidifying device in accordance with the present invention comprises a support member 1, at least one UV LED module 2, a top cover 3, and a base 4. The at least one UV LED module 2 is installed on the support member 1, and the top cover 3 is mounted to a top of the support member 1. The support member 1 is disposed on the base 4. The UV liquid gel solidifying device of the present invention uses LED light source to solidify the liquid gel coated on the fingernails or toenails.

The support member 1 is made by a metal plate and is formed to have multiple walls 11. Two adjacent walls 11 form an included angle of between 90 degrees and 175 degrees. The walls 11 define a first chamber 10 with a first open end 12 through which the fingernails coated with the UV liquid gel can be inserted. Due to a specific angular arrangement of the walls 11, the fingernails can be sufficiently exposed by the UV light. The walls 11 can be coated with any of the following alloy to form a reflective layer to reflect the UV light, such as silver, nickel, cobalt, aluminum, and a combination thereof. These metal layers are non-toxic and can reflect the UV light. The support member 1 has an integrated connection portion 13 to which the top cover 3 is mounted, and the connection portion 13 also allows the support member 1 to be firmly disposed on a top surface 41 of the base 4.

The at least one UV LED module 2 is installed to one of the walls 11. The UV LED module 2 has a UV LED light source 21 facing toward the first chamber 10, and the walls 11 can reflect and guide light emitted from the UV LED light source 21. In this embodiment, each wall 11 is installed with a UV LED module 2. Each wall 11 has an installation hole 14 and multiple rods 15 located beside the installation hole 14. Each UV LED module 2 includes the UV LED light source 21, a circuit board 22, a heat dissipation board 23, and a light guide mask 24. The UV LED light source 21 is electrically connected to the circuit board 22 and enclosed at a center of the light guide mask 24. The heat dissipation board 23 is connected beneath the circuit board 22. The circuit board 22 and the heat dissipation board 23 of each UV LED module 2 are mounted to the rods 15 by screws or bolts (not shown). The light guide mask 24 is installed in the installation hole 14 which is slightly larger than an outer diameter of the light guide mask 24, so that the UV LED light does not leak from a gap between the installation hole 14 and the light guide mask 24. The UV LED light source 21 faces toward the first chamber 10 and the light guide mask 24 can focus and guide the UV light. The UV LED module 2 or the UV LED can be lamp-type LED, SMD-type LED, or can-shaped LED. The UV LED light source 21 generates a light wavelength of between 360 nm to 460 nm.

A controller 5 is disposed to another wall 11 at a back of the support member 1, and the controller 5 is electrically connected to the at least one UV LED module 2. The controller 5 includes a start-up button 51, a control button 52, and a circuit board 53.

The top cover 3 is detachably mounted to a top of the support member 1. The top cover 3 has a second chamber 30 defined there beneath for receiving the support member 1 when the top cover 3 is assembled with the support member 1. The top cover 3 has a second open end 31 parallel to the first open end 12. Multiple ventilation holes 32 are provided on a top of the top cover 3 and close to the second open end 31, so as to dissipate heat generated from the UV LED light source 21. An installation portion 33 is provided on the top cover 3 opposite to the ventilation holes 32, and the controller 5 is installed to the installation portion 33. A slide cover 6 is slideably mounted to the top cover 3. When the slide cover 6 is moved toward a first direction, the first and second open ends 12, 31 are opened so that the user's fingernails can put in the first chamber 10 for treatment. When the slide cover 6 is released to revert back to its original position to close the first and second open ends 12, 31, the user's eyes can avoid from being directly exposed to the UV light. In this embodiment, a resilient member 7 is located between the slide cover 6 and the top cover 3 so as to allow the slide cover 6 to move back and forth. The resilient member 7 comprises two slider springs 71 each having a first fixed end 711 and a second fixed end 712. A resilient structure 713 is located between the first and second fixed ends 711, 712. The two respective first fixed ends 711 are fixed to the slide cover 6, the two respective second fixed ends 712 are symmetrically and slideably mounted on the top cover 3, in which an angle of about 30 degrees is defined between the first and second fixed ends 711, 712 of the two slider springs 71. In this embodiment, two symmetric installation slots 34 are defined on a surface of the top cover 3 above the second open end 31, and a sliding slot 35 is defined on the surface of the top cover 3 between the two installation slots 34. The two respective first fixed ends 711 are fixed to the slide cover 6 and slideably engaged with the sliding slot 35, and the two second fixed ends 712 are slideably mounted on the two respective installation slots 34, so that the slide cover 6 can be moved back and forth relative to the second open end 31. An inner edge of the top cover 3 and the connection portion 13 of the support member 1 can also be assembled to each other by screws, bolts, or magnets (not shown in Figures), for allowing convenient assembly and disassembly.

The base 4 is detachably assembled to an underside of the support member 1. The base 4 has a third chamber 40 defined there beneath and a third open end 42 located at the same side as the first open end 12. The third chamber 40 is isolated from the UV LED light source 21. The fingers to be treated by the UV LED light can insert into the first chamber 10 and put on the top surface 41 of the base 4, and the remaining fingers not to be treated can insert into the third chamber 40. The top surface 41 of the base 4 may have an opening 43 to reinforce the heat dissipation, and the shape of the opening 43 can be any known shape such as a circular opening. A separation board 44 is located on the top surface 41 of the base 4. The fingers to be treated by the UV LED light can insert into the first chamber 10 and put on the separation board 44. Multiple magnets are located between the separation board 44 and the support member 1 so that the base 4 and the support member 1 can be quickly disassembled from each other. The connection portion 13 has multiple rods 15 connected to an underside thereof. The separation board 44 and the top surface 41 of the base 4 have installation holes 441 whose shape and number are corresponding to those of the rods 15. The rods 15 are inserted into the installation holes 441 so as to assemble the support member 1 and the base 4 together. Some of the installation holes 441 are eccentric to a center of the corresponding rods 15.

Figure 4:
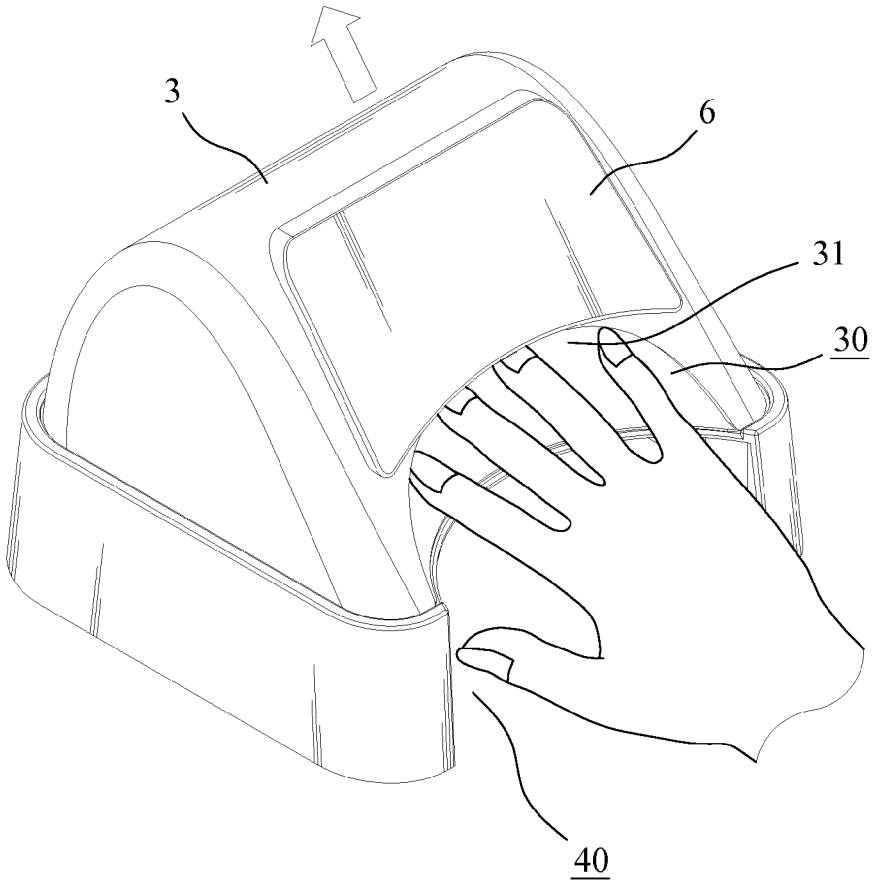
FIG. 4 is a perspective view to show the fingernails are treated by the UV liquid gel solidifying device in accordance with the present invention.
Figure 5:
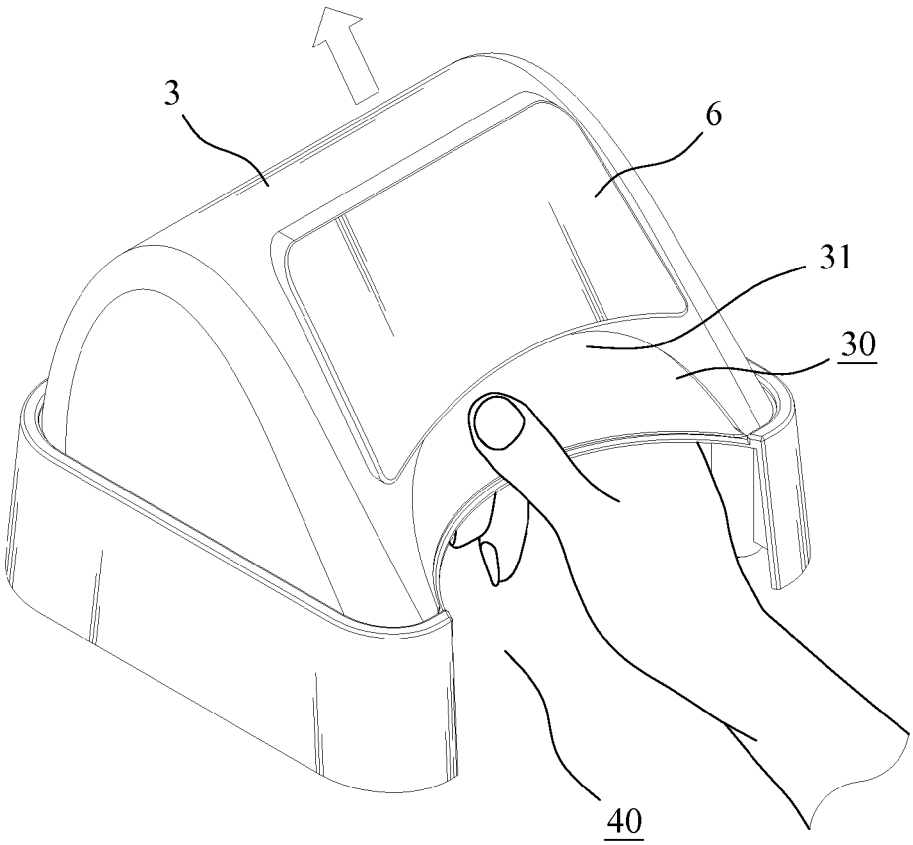
FIG. 5 is another perspective view to show the thumbnail is treated by the UV liquid gel solidifying device in accordance with the present invention.
Figure 6:
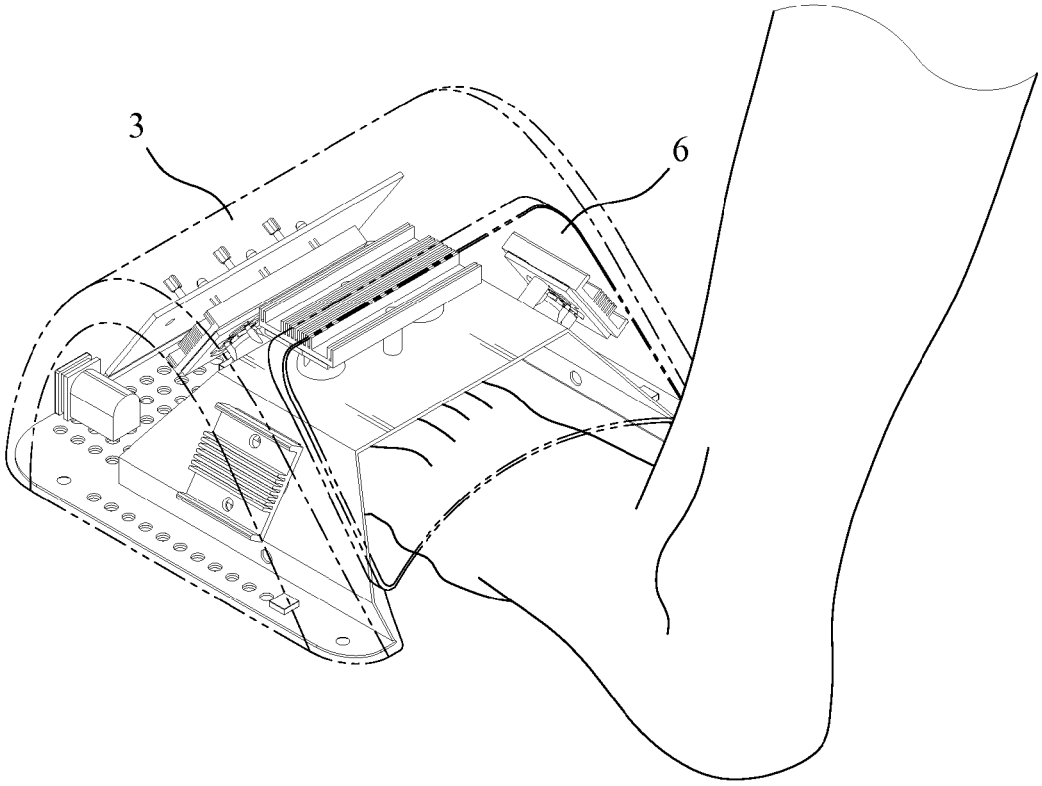
FIG. 6 is a perspective view to show the toenails are treated by the UV liquid gel solidifying device in accordance with the present invention.

Referring to FIGS. 3-6, especially to FIG. 4, when the fingernails (except for the thumbnail) coated with the UV liquid gel are to be treated, the slide cover 6 is pushed upward to open the second open end 31 of the top cover 3 and the first open end 12 of the support member 1, the four fingernails insert in the first chamber 10 and put on the separation board 44. The thumb inserts into the third chamber 40, which is isolated from the UV LED module 2 by the separation board 44. The slide cover 6 is then released to revert back to its original position to close the first and second open ends 12, 31, so that the user's eyes can avoid from being exposed to the UV light. The power is turned ON to solidify the UV liquid gel coated on the fingernails. As shown in FIG. 5, when the thumbnail coated with the UV liquid gel is to be treated, the thumb inserts into the first chamber 10 and put on the separation board 44. The rest fingers insert into the third chamber 40, which is isolated from the UV LED light by the separation board 44. The conventional solidifying devices do not have the base and have to be put at the edge of the table so that the fingers can put on the table for treatment. The UV liquid gel solidifying device of the present invention has the base so that there is no need to put it at the edge of the table. It is very convenient for the users. When the toenails coated with the UV liquid gel are to be treated, the separation board 44 and the base 4 are first disassembled from the rods and/or the magnets on the support member 1. The whole set of the support member 1 and the top cover 3 are disposed over the toenails. In other words, when the slide cover 6 is pushed upward, the user's foot inserts into the first chamber 10 via the second open end 31 and the first open end 12 for treatment.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A UV liquid gel solidifying device for nail art, comprising a support member having multiple walls arranged to have an included angle between adjacent two walls and define a first chamber with a first open end, the walls being a light reflective wall;

at least one UV LED module installed to one of the walls and having a UV LED light source facing toward the first chamber, the walls being capable of reflecting and guiding light emitted from the UV LED light source;

a controller disposed to another wall and electrically connected to the at least one UV LED module;

a top cover detachably mounted to a top of the support member and having a second chamber defined there beneath for receiving the support member and a second open end parallel to the first open end, the top cover having a slide cover slideably mounted thereto, wherein when the slide cover moves toward a first direction, the first open end and the second open end are opened, when the slide cover is released to revert back to close the first open end and the second open end, the user's eyes are capable of avoiding from being directly exposed to the UV light; and a base detachably assembled to an underside of the support member and having a third chamber defined there beneath and a third open end located at the same side as the first open end, the third chamber being isolated from the UV LED light source, the fingers to be treated by the UV LED light being capable of inserting into the first chamber and putting on a top surface of the base, and the remaining fingers not to be treated being capable of inserting into the third chamber, wherein when the base is disassembled from the support member, the toenails coated with the UV liquid gel are capable of inserting in the first chamber for treatment.

2. The UV liquid gel solidifying device as claimed in claim 1, wherein a resilient member is located between the slide cover and the top cover so as to allow the slide cover to move back and forth.

3. The UV liquid gel solidifying device as claimed in claim 2, wherein the resilient member comprises two slider springs each having a first fixed end and a second fixed end, a resilient structure is located between the first and second fixed ends, the two respective first fixed ends are fixed to the slide cover, the two respective second fixed ends are symmetrically and slideably mounted on two respective installation slots defined on a surface of the top cover, in which an angle of about 30 degrees is defined between the first and second fixed ends of the two slider spring, a sliding slot is defined on the surface of the top cover between the two installation slots, the two respective first fixed ends are slideably engaged with the sliding slot, so that the slide cover is capable of being moved back and forth relative to the second open end.

4. The UV liquid gel solidifying device as claimed in claim 1, wherein a separation board is disposed on a top of the base, and multiple magnets are disposed between the separation board and the support member, for providing convenient and fast assembly and disassembly between the base and the support member.

5. The UV liquid gel solidifying device as claimed in claim 4, wherein the support member has a connection portion, on which the top cover is mounted, the connection portion has multiple rods connected to an underside thereof, the separation board and the top surface of the base have installation holes whose shape and number are corresponding to those of the rods, the rods are inserted into the installation holes so as to assemble the support member, the separation board and the base together, some of the installation holes are eccentric to a center of the corresponding rods.

6. The UV liquid gel solidifying device as claimed in claim 1, wherein the top cover is provide with multiple ventilation holes on a top thereof and an installation portion for installing the controller thereto.

7. The UV liquid gel solidifying device as claimed in claim 1, wherein the at least one UV LED module comprises a circuit board, a heat dissipation board, and a light guide mask, the UV LED light source is electrically connected to the circuit board and enclosed at a center of the light guide mask, the heat dissipation board is connected beneath the circuit board.

8. The UV liquid gel solidifying device as claimed in claim 7, wherein the walls of the support member has an installation hole and multiple rods located beside the installation hole, the at least one UV LED module is connected to the rods, the light guide mask is installed in the installation hole, and the UV LED light source faces toward the first chamber.

9. The UV liquid gel solidifying device as claimed in claim 5, wherein multiple magnets are disposed between the connection portion and an inner edge of the top cover.

* * * * *